US006363948B2

(12) United States Patent
Choi

(10) Patent No.: US 6,363,948 B2
(45) Date of Patent: Apr. 2, 2002

(54) COSMETIC BRUSH ASSEMBLY

(76) Inventor: Man Soo Choi, Hyundai Apt. 301-502, Sa-Dong, Ansan-Shi, Kyungki-Do (KR)

( * ) Notice: Subject to any disclaimer, the term of this patent is extended or adjusted under 35 U.S.C. 154(b) by 0 days.

(21) Appl. No.: 09/734,484

(22) Filed: Dec. 11, 2000

(30) Foreign Application Priority Data

Jul. 31, 2000 (KR) ..... 2000-44230

(51) Int. Cl.[7] ..... A45D 44/18; A45D 40/24; A04S 40/26

(52) U.S. Cl. ..... 132/313; 132/317; 132/318; 132/320

(58) Field of Search ..... 132/313, 317, 132/318, 320, 308; 206/581, 823, 361, 15.2, 15.3; 401/102, 117; 15/167.1

(56) References Cited

U.S. PATENT DOCUMENTS 3,167,806 A * 2/1965 Hogan ..... 132/313
4,966,479 A 10/1990 Idec et al.
5,339,483 A * 8/1994 Byun ..... 15/184
5,377,842 A * 1/1995 Sorini ..... 206/581
5,746,531 A * 5/1998 Izhak ..... 401/139
5,813,421 A 9/1998 Wang
6,039,052 A * 3/2000 Choi ..... 132/313
6,234,181 B1 * 5/2001 Lou ..... 132/313

* cited by examiner

*Primary Examiner*—John J. Wilson
*Assistant Examiner*—Robyn Kieu Doan
(74) *Attorney, Agent, or Firm*—Schmeiser,Olsen & Watts

(57) ABSTRACT

Disclosed is a cosmetic brush assembly capable of having a cosmetic powder retaining tank on an end thereof and injecting a cosmetic powder from the cosmetic powder retaining tank to a brush by the air pumping operation of an air pumping part, thereby increasing an injection force of the cosmetic powder and adjusting an amount of cosmetic powder injected. The cosmetic brush assembly includes: a brush mounting member having a brush mounted on the one end thereof; a cosmetic powder retaining tank disposed on the one end of the brush mounting member and retaining a cosmetic powder therein; an air pump part mounted on the lower end of the cosmetic powder retaining tank; an injection nozzle having a plurality of injecting holes inserted into the interior of the brush and for guiding the cosmetic powder in the cosmetic powder retaining tank injected by a pumping operation of the air pumping part to the brush and a powder incoming end disposed toward the cosmetic powder retaining tank; and an adjusting part disposed between the brush mounting member and the cosmetic powder retaining tank, for adjusting an amount of the cosmetic powder injected from the cosmetic powder retaining tank to the brush via the injection nozzle.

19 Claims, 13 Drawing Sheets

(a)

(b)

COSMETIC BRUSH ASSEMBLY

FIELD OF THE INVENTION

The present invention relates to a cosmetic brush assembly having a brush used for the application of a cosmetic powder on one end and capable of coupling a cosmetic powder retaining tank on the other end. Cosmetic powder in the cosmetic powder retaining tank can be injected into the brush by the action of air pumping such that in use, the injection force of the cosmetic powder can be increased and an amount of cosmetic powder injected can be adjusted.

DESCRIPTION OF THE RELATED ART

In order for a user to paint a cosmetic powder retained in a powder case on his or her face, generally, she first opens the cover of the powder case and then covers the brush mounted on a cosmetic brush assembly with cosmetic powder exposed to the outside. After the completion of the application of makeup, however, she frequently fails to keep her powder case in a clean state due to the carelessness of the treatment.

Additionally, it is inconvenient to carry both the powder case and the cosmetic brush assembly, respectively.

In a conventional cosmetic brush assembly, typically, the brush and the cosmetic powder tank are simply connected to each other, such that when the cosmetic powder is injected to the brush, the air pressure is dispersed and is thus difficult to reach the terminating end of the brush. In addition, because of a simple configuration, an amount of the cosmetic powder injected cannot be appropriately adjusted. As a result, it has been found that the brush is not uniformly covered with the cosmetic powder. With the conventional cosmetic brush assembly, therefore, a user cannot achieve a desired application of cosmetic powder.

SUMMARY OF THE INVENTION

It is, therefore, an object of the present invention to provide a cosmetic brush assembly capable of having a cosmetic powder retaining tank on the one end thereof, whereby a cosmetic powder in the cosmetic powder retaining tank is injected to a brush by air pumping.

It is another object of the present invention to provide a cosmetic brush assembly capable of adjusting an amount of cosmetic powder injected to a brush from the cosmetic powder retaining tank and injecting the cosmetic powder to the whole brush in a uniform manner.

It is yet another object of the present invention to provide a cosmetic brush assembly capable of keeping a cosmetic powder in an easy manner, thereby preventing the interior of a handbag from being stained with the cosmetic powder, while a powder case is kept in the handbag.

It is still another object of the present invention to provide a cosmetic brush assembly capable of having a beautiful appearance an d exerting various kinds of functions.

To attain these and other objects of the present invention, there is provided a cosmetic powder assembly including: a brush mounting member having a brush mounted on the one end thereof; a cosmetic powder retaining tank disposed on the other end of the brush mounting member and retaining a cosmetic powder therein; an air pump part mounted on the lower end of the cosmetic powder retaining tank; an injection nozzle having a plurality of injecting holes embedded in the brush in order to guide the cosmetic powder in the cosmetic powder retaining tank. The cosmetic powder can be injected into the brush by a pumping operation of the air pumping part which forces cosmetic powder to enter the injection nozzle through a powder entering end. The powder entering end of the pumping part is disposed toward the cosmetic powder retaining tank. The cosmetic powder assembly also includes an adjusting part disposed between the brush mounting member and the cosmetic powder retaining tank to adjust an amount of the cosmetic powder injected from the cosmetic powder retaining tank to the brush via the injection nozzle.

DETAILED DESCRIPTION OF THE PREFERRED EMBODIMENT

Now, an explanation of the configuration of a cosmetic brush assembly according to the present invention will be hereinafter discussed with reference to the accompanying drawings.

Figure 1:
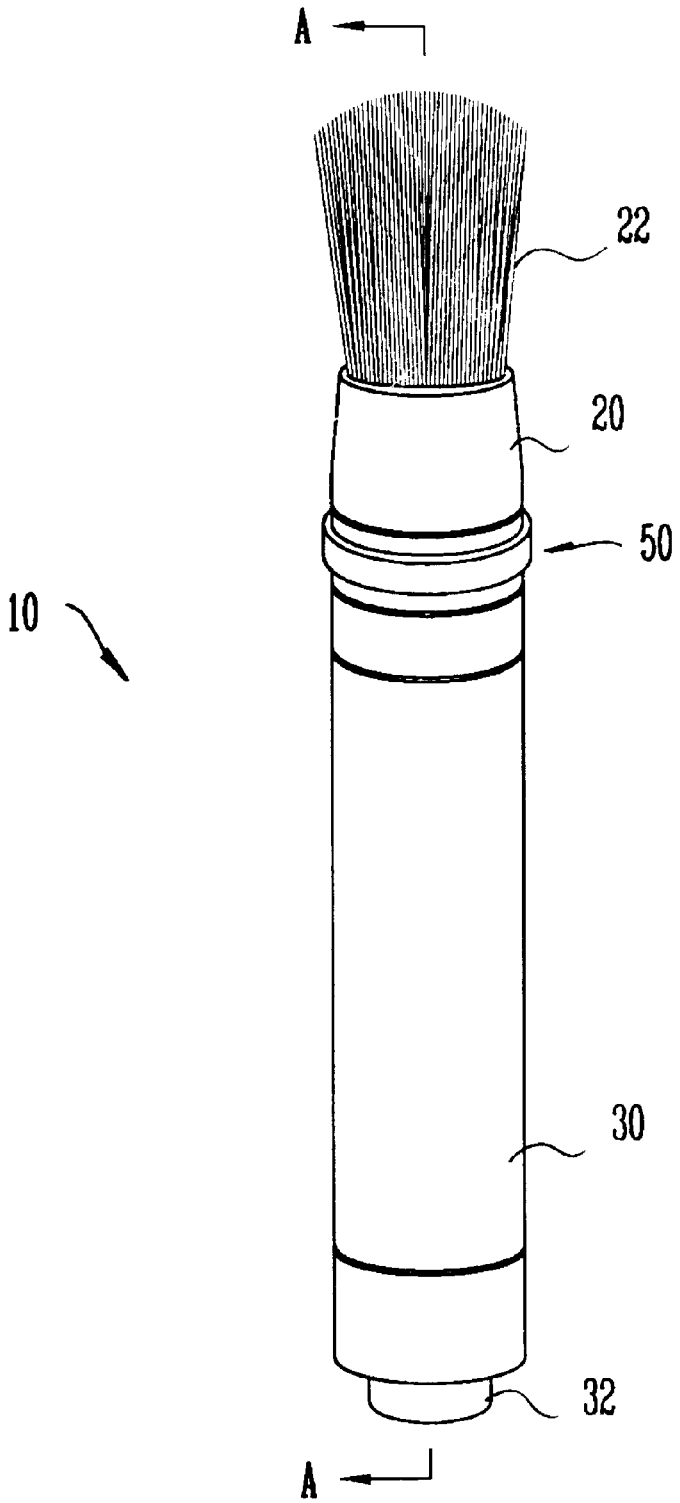
FIG. 1 is a perspective view of a cosmetic brush assembly according to an embodiment of the present invention.
Figure 2:
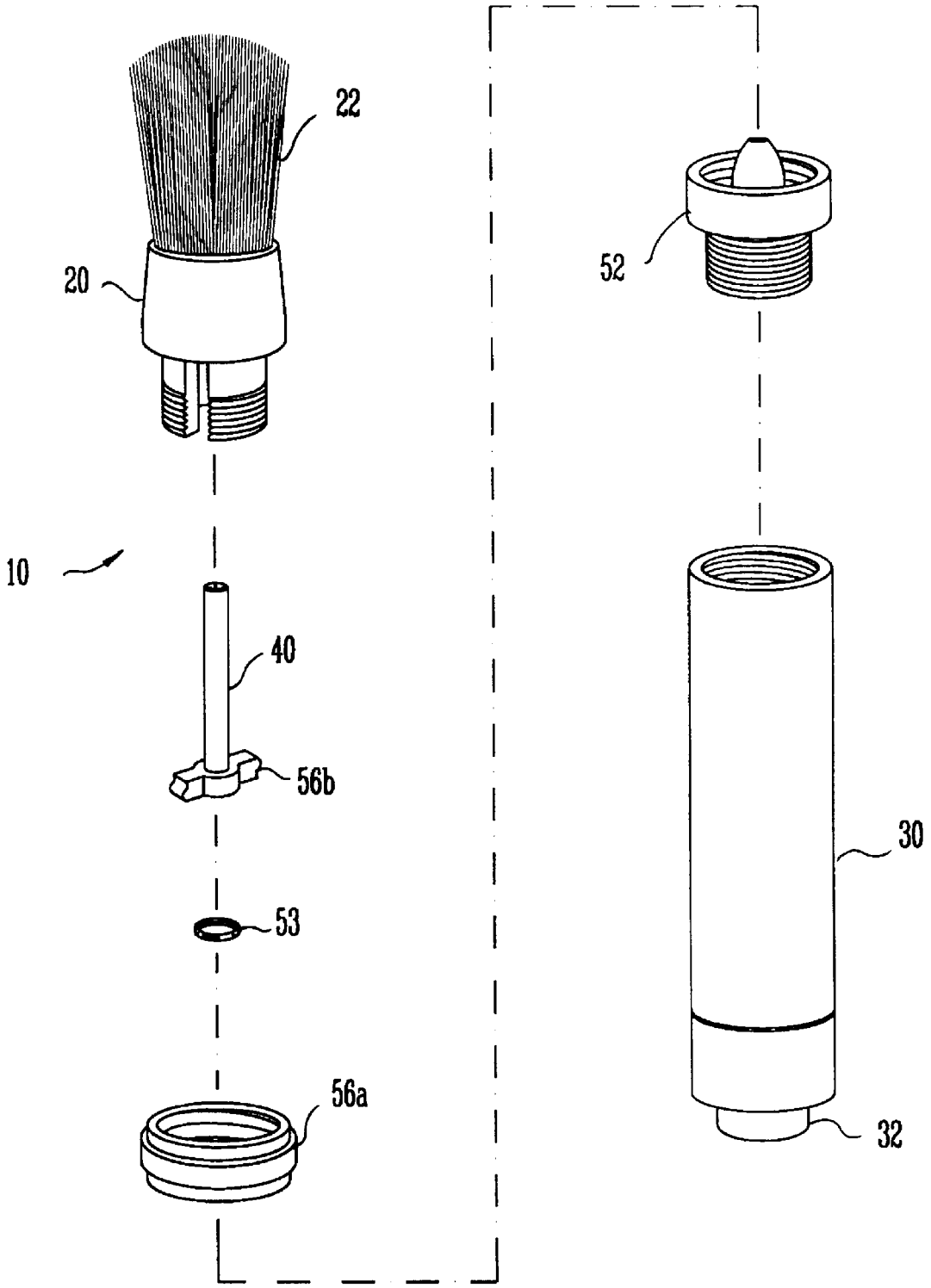
FIG. 2 is an exploded perspective view of FIG. 1.
Figure 3:
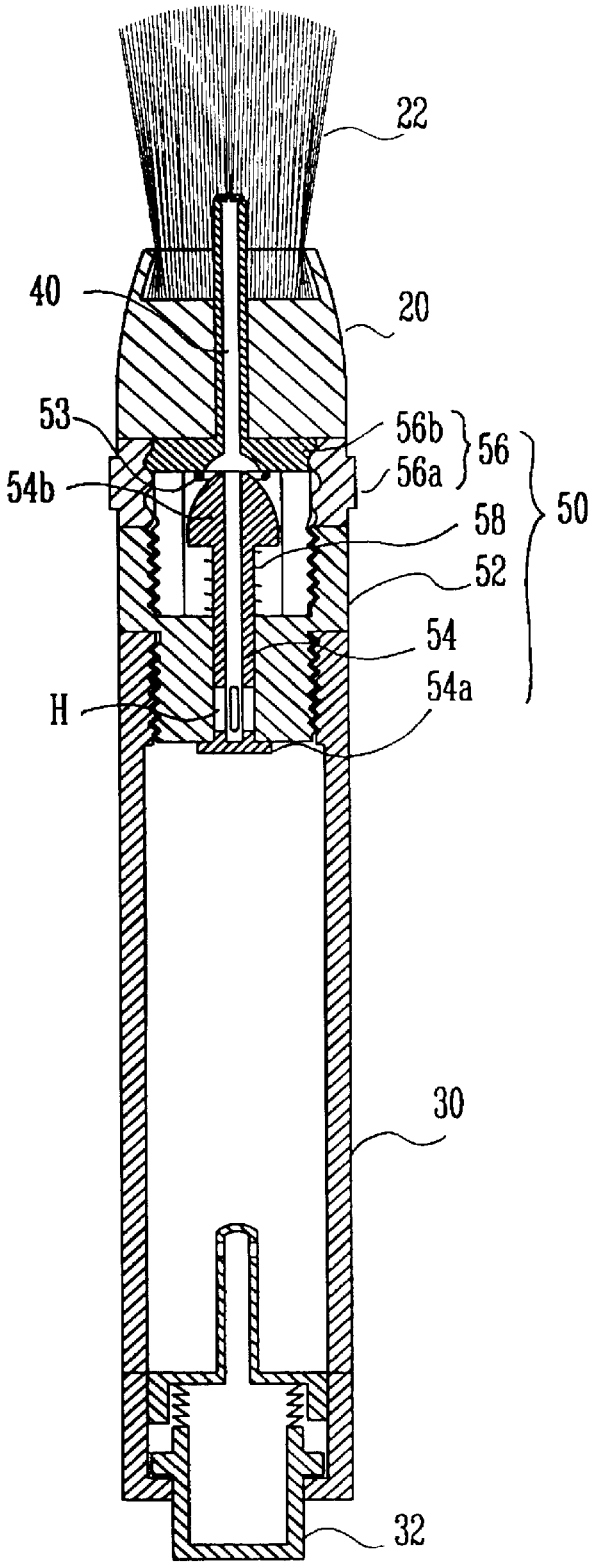
FIG. 3 is a sectional view taken along the line A—A in FIG. 1.
Figure 4:
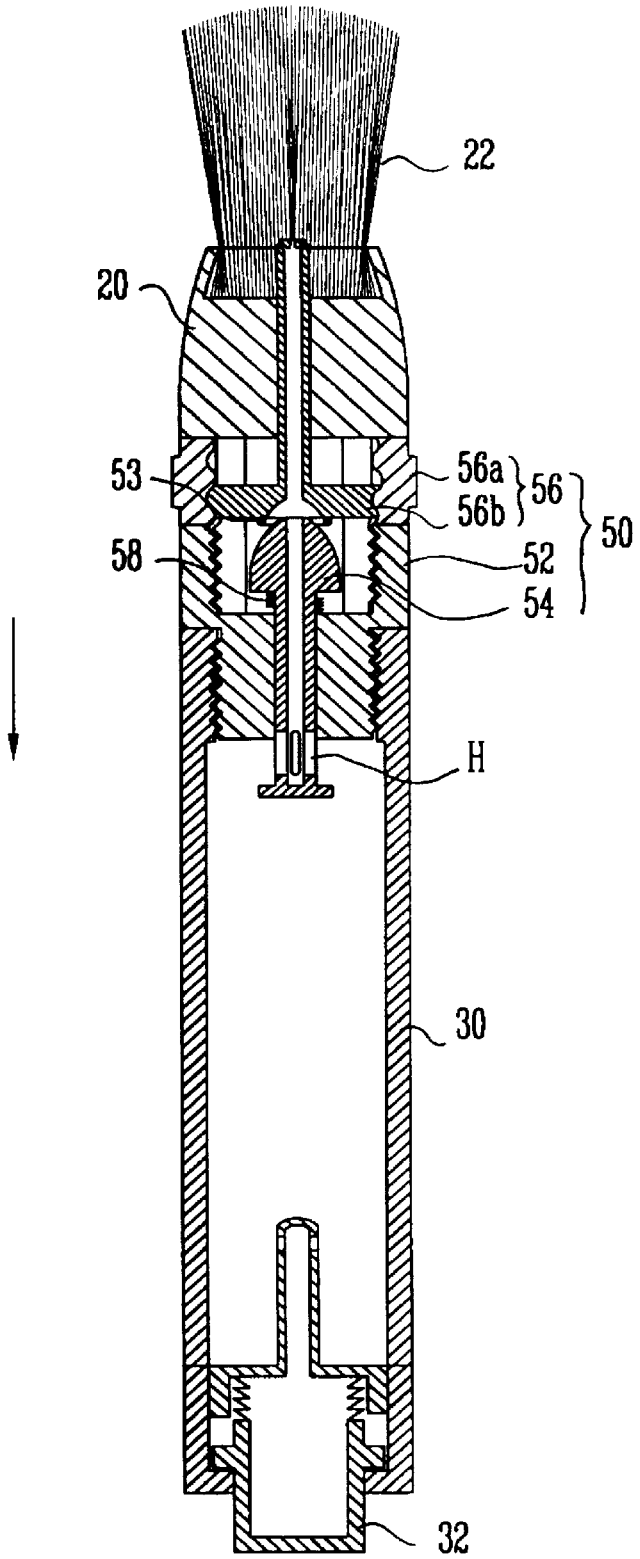
FIG. 4 is a sectional view illustrating the state where the end of the cosmetic powder retaining tank is open by the action of an injection nozzle.
Figure 5:
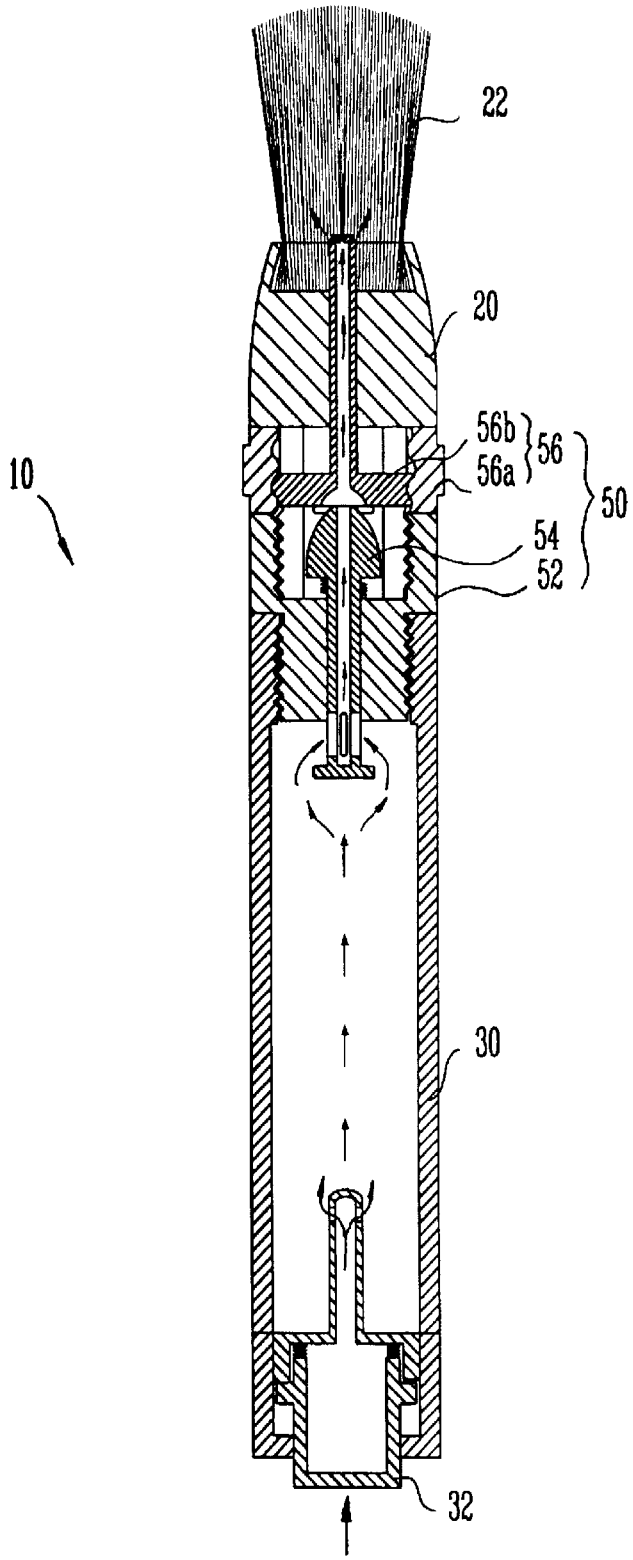
FIG. 5 is a sectional view illustrating the state where the cosmetic powder in the cosmetic powder retaining tank is injected to the brush through the injection nozzle by the operation of an air pumping part.
Figure 6:
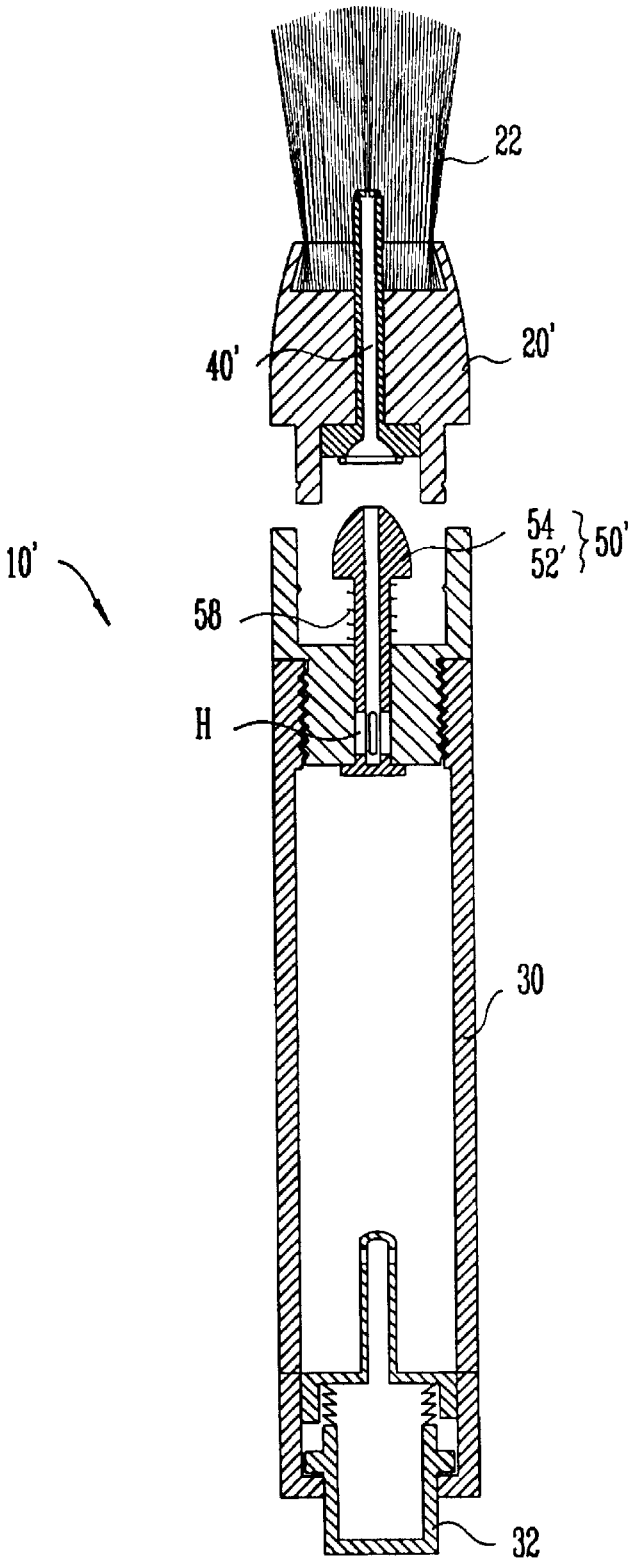
FIG. 6 is a sectional view illustrating a cosmetic brush assembly according to another embodiment of the present invention.
Figure 7:
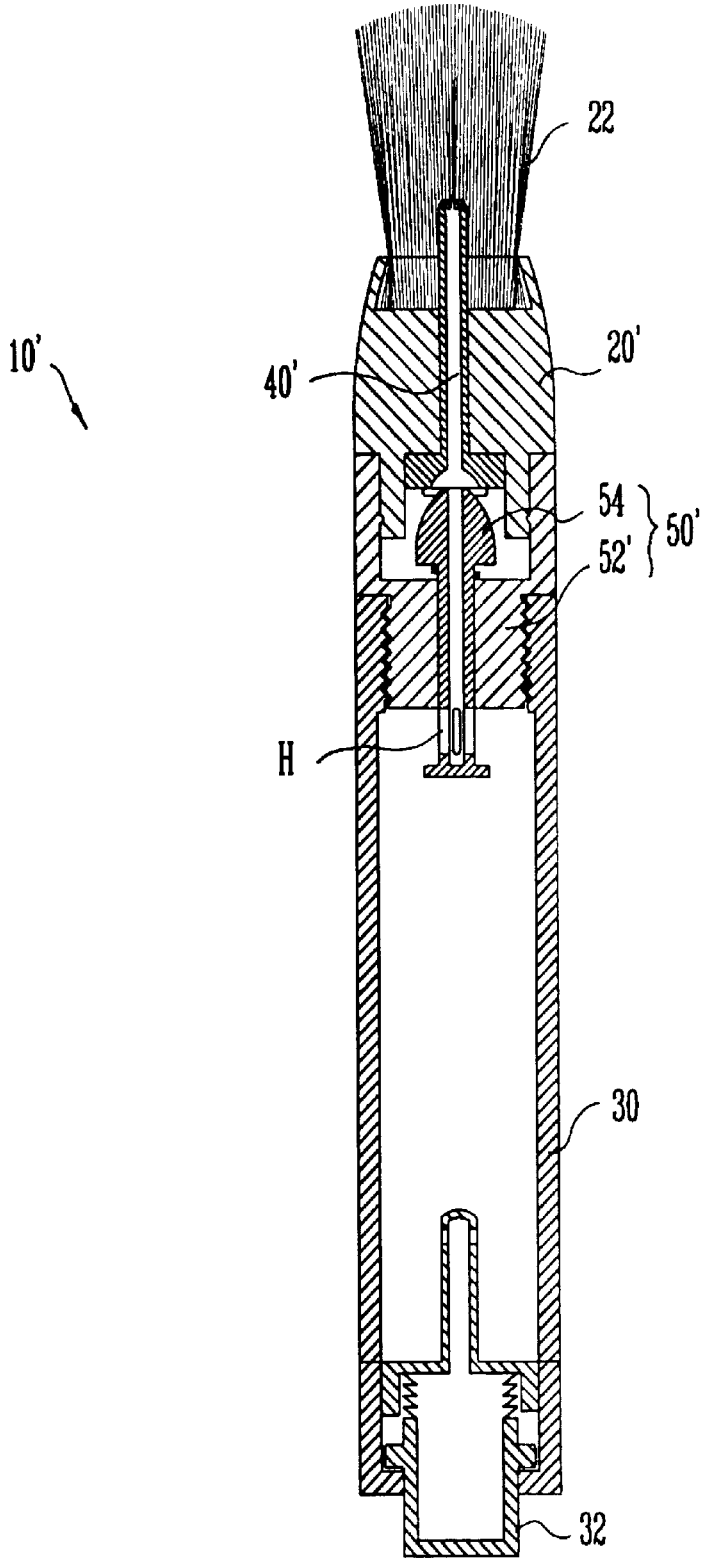
FIG. 7 is a sectional view illustrating the coupling state of the cosmetic brush assembly of FIG. 6.

FIG. 1 is a perspective view of a cosmetic brush assembly according to an embodiment of the present invention. FIG. 2 is an exploded perspective view of FIG. 1. FIG. 3 is a sectional view taken along the line A—A in FIG. 1. FIG. 4 is a sectional view illustrating the state where the opened end of the cosmetic powder retaining tank is in an opened state by the action of an injection nozzle. FIG. 5 is a sectional view illustrating the state where the cosmetic powder in the cosmetic powder retaining tank is injected through an injection nozzle by the operation of an air pumping part. FIG. 6 is a sectional view illustrating the state before the cosmetic brush assembly according to another embodiment of the present invention, is coupled. FIG. 7 is a sectional view illustrating the coupling state of the cosmetic brush assembly of FIG. 6.

Referring to FIG. 1, a cosmetic brush assembly 10 according to the present invention includes a brush mounting member 20 having a brush 22 on the top end thereof. The brush mounting member 20 is a substantially hollow cylinder and has a screw or protrusion (or groove) on the bottom end thereof, into which an adjusting part 50 for adjusting an amount of cosmetic powder injected is screw-coupled or fitted. FIG. 2 illustrates that an injection nozzle 40, which functions to guide the cosmetic powder to the brush 22, is inserted into the hollow portion of the brush mounting member 20.

The injection nozzle 40 serves to guide the flow of the cosmetic powder supplied from a cosmetic powder retaining tank 30 and may be substantially a cylinder. The injection nozzle 40 has a closed top end with a plurality of injection holes of predetermined sizes and an opened bottom end. Also, the closed top end of the injecting nozzle 40 is placed in the interior of the brush 22, for directly injecting cosmetic powder to the brush 22.

As mentioned above, the brush mounting member 20 is screw-coupled on the bottom end of the adjusting part 50 (see FIG. 1) for adjusting an amount of cosmetic powder injected to the brush 22. Also, the adjusting part 50 is screw-coupled to the cosmetic powder retaining tank 30 as will be discussed below.

Referring now to FIG. 3, the adjusting part 50 includes a hollow housing 52 screw-coupled to the cosmetic powder retaining tank 30, a tubular body 54 inserted into the hollow housing 52 under the support of an elastic body to close the hollow portion of the hollow housing 52, and a pressure member 56 for applying a force to the tubular body 54 to open the hollow portion of the hollow housing 52.

The pressure member 56 of the adjusting part 50 is composed of a substantially cylindrical member 56*a* which fits between the brush mounting member 20 and the adjusting part 50. The brush mounting member 20 and the adjusting part 50 may be screw-coupled to each other. The pressure member 56 of the adjusting part 50 also has a horizontal member 56*b* screw-coupled on the inside of the cylindrical member 56*a* and moving in a length-wise direction of the cosmetic brush assembly 10.

The horizontal member 56*b* may be formed integrally with the opened bottom end of the injection nozzle 40. And, graduations for measuring an amount of movement of the cylindrical member 56*a* are arranged on the outside of the cylindrical member 56*a*. Thus, the amount of movement of the cylindrical member 56*a* can be checked by the eyes of a user, so that an amount of cosmetic powder injected from the cosmetic powder retaining tank 30 can be adjusted. However, it can be appreciated to those skilled in the art that means for measuring the amount of movement of the cylindrical member 56*a* is not limited to the graduations.

The cosmetic powder retaining tank 30 retains the cosmetic powder therein and is provided with an air pumping part 32 on its bottom end for injecting the cosmetic powder to the brush 22.

Therefore, the cosmetic powder in the cosmetic powder retaining tank 30 is uniformly injected via the injection nozzle 40 to the brush 22, as indicated by arrows in FIG. 5, by the air pressure flowing into the cosmetic powder retaining tank 30 by the air pumping of the air pumping part 32. Then, the user of the cosmetic brush assembly 10 can paint the cosmetic powder on his or her face in the same manner as conventional practice.

Referring now to FIGS. 3 to 5, an explanation of an operation state of the cosmetic powder brush assembly 10 according to an embodiment of the present invention will be discussed.

Referring to FIG. 3, the hollow housing 52 of the adjusting part 50 is screw-coupled between the cosmetic powder retaining tank 30 (having the air pumping part 32 on the bottom end thereof) and the brush mounting member 20. The cosmetic powder retaining tank 30 has an air pumping part 32 on its bottom end. The injection nozzle 40 is inserted into the hollow portion of the brush mounting member 20.

The tubular body 54 is inserted into the hollow housing 52 of the adjusting part 50 and flanges 54*a* and 54*b* of predetermined sizes are attached on both ends thereof. Flanges 54*a* and 54*b* function to prevent the tubular body 54 from deviating from the hollow housing 52, thereby making it possible to move the tubular body 54 in a length-wise direction.

On the other hand, the tubular body 54 is provided with a plurality of substantially oval holes H. The tubular body 54 has an opened top end on which the cut conical flange 54*b* is attached. The cosmetic powder in the cosmetic powder retaining tank 30 flows into the plurality of holes H on the side of the tubular body 54 and is injected through the opened top end of the tubular body 54, as indicated by arrows in FIG. 5.

Between the lower portion of the top end of the tubular body 54 and the upper portion of the inside hollow portion of the hollow housing 52 is provided an elastic body 58 and the flange 54*a* of the lower portion of the tubular body 54. The tubular body 54 is kept completely enclosed in the upper portion of the hollow housing 52. In this state, the holes H formed on the side of the tubular body 54 are kept completely closed by the inside of the hollow housing 52.

As discussed above, in the state where the holes H on the side of the tubular body 54 are closed, if the cylindrical member 56*a* of the pressure member 56 of the adjusting part 50 is adjusted, the horizontal member 56*b* (screw-coupled to the inside of the cylindrical member 56*a*) moves horizontally along the direction of an arrow as indicated in FIG. 4. As the horizontal member 56*b* moves in a length-wise direction along the length of the cosmetic brush assembly 10, a force in the arrow direction of FIG. 4 is applied to the tubular body 54 of the adjusting part 50, such that the tubular body 54, which is in contact with the horizontal member 56*b* , moves in the same direction as indicated by the arrow in FIG. 4.

As a result, the oval holes H formed on the side of the tubular body 54 are exposed to the outside of the hollow housing 52 and extended into the interior of the cosmetic powder retaining tank 30. In the state where the top end of the tubular body 54 of the adjusting part 50 has been in contact with the horizontal body 56*b*, the opened top end of the tubular body 54 and the opened bottom end of the injection nozzle 40 communicate with each other, thereby allowing air to flow from the cosmetic powder retaining tank 30, through the tubular body 54, through the bottom end of the injection nozzle 40, and through the injection nozzle 40. Between the top end of the tubular body 54 and the horizontal member 56*b* is provided a rubber packing material 53 for maintaining the air connection in a tightly closed state.

Referring to FIG. 5, in the state where the oval holes H on the side of the tubular body have been exposed to the interior of the cosmetic powder retaining tank 30, if a pumping switch of the air pumping part 32 is pressed toward the arrow direction, air flows to the cosmetic powder retaining tank 30 through an air discharging hole of the discharging nozzle of the air pumping part 32. The air flowing into the cosmetic powder retaining tank 30 flows in the interior of the tubular body 54 via the oval holes H on the side of the tubular body 54 and is then discharged to the brush 22 through the injection holes of the injection nozzle 40. Therefore, the cosmetic powder in the cosmetic powder retaining tank 30 is injected to the brush 22 along the above air flowing passage.

As a consequence, the brush 22 is uniformly covered with the cosmetic powder, without any irregular covering, such that the user can paint the cosmetic powder on his or her face in the same manner as in the conventional practice.

After the application of cosmetic powder, if the cylindrical member 56*a* of the pressure member 56 in the adjusting part 50 is moved in the opposite direction thereto, the horizontal member 56*b*, screw-coupled on the inside of the cylindrical member 56*a*, moves in the opposite direction to the arrow direction of FIG. 4. In engagement therewith, the tubular body 54 of the adjusting part 50 moves to the top end of the hollow housing 52 by the elastic force of the elastic body 58. As a result, the oval holes H on the side of the tubular body 54 are placed in a closed state in relation to the hollow housing 52.

In the closed state, where the brush mounting member 20 and the adjusting part 50 are unscrewed from each other or closed in relation to each other, the user can carry the cosmetic brush assembly in a more convenient manner.

When the cosmetic powder in the cosmetic powder retaining tank 30 is all consumed, the hollow housing 52 of the adjusting part 50 is separated or removed and new cosmetic powder is filled in the cosmetic powder retaining tank 30. Next, the hollow housing 52 is re-assembled to the cosmetic powder retaining tank 30, such that the cosmetic brush assembly according to the present invention can be refilled and reused.

Also, the opened top end of the cosmetic powder retaining tank 30 can be closed. The adjusting part 50 and the oval holes H on the side of the tubular body are kept in the closed state by means of the elastic force of the elastic body 58, thereby preventing the cosmetic powder in the cosmetic powder retaining tank 30 from leaking to the outside. Thus, the cosmetic brush assembly according to the present invention can be kept in a clean state.

FIGS. 6 and 7 show the cosmetic brush assembly according to another embodiment of the present invention, in which the similar reference numbers to those indicated in FIGS. 1 to 5 are indicated with a prime. Also, an explanation of the same parts in the one embodiment of the present invention will be avoided for the brevity of the description.

Referring to FIG. 6, first, the adjusting part 50', which is mounted between the brush mounting member 20' and the cosmetic powder retaining tank 30, includes the hollow housing 52' and the tubular body 54. The hollow housing 52' is screw-coupled to the cosmetic powder retaining tank 30 and fitted to the brush mounting member 20'. In other words, the brush mounting member 20' is provided with reentrant grooves on the outside of the bottom end thereof, and in correspondence with the reentrant grooves, the hollow housing 52' is provided with protrusions on the inside of the top end thereof. And, the tubular body 54 is elastically supported and inserted into the hollow portion of the hollow housing 52'. therefore, in the state where the tubular body 54 is supported by means of an elastic body 58, the top end of the cosmetic powder retaining tank 30 is kept in the closed state by means of the adjusting part 50'.

FIG. 7 illustrates the open state in which the brush mounting member 20' is fitted to the top end of the hollow housing 52' of the adjusting part 50'. In this open state, the injection nozzle 40', which is inserted into the hollow portion of the brush mounting member 20', applies a force to the top end of the tubular body 54. As a consequence, the holes H formed on the side of the bottom end of the tubular body 54 are exposed to the interior of the cosmetic powder retaining tank 30.

In this open state, if the air pumping part 32 mounted on the bottom end of the cosmetic powder retaining tank 30 is manipulated, the air flowing to the cosmetic powder retaining tank 30 moves along the air flowing passage in the interior of the cosmetic brush assembly, thereby delivering the cosmetic powder to the brush, as discussed above.

FIG. 6 illustrates that a substantially cylindrical flange is attached on the bottom end of the injection nozzle 40' inserted into the hollow portion of the brush mounting member 20. Also, rubber packing material is disposed between the cylindrical flange and the top end of the tubular body 54.

Figure 8:
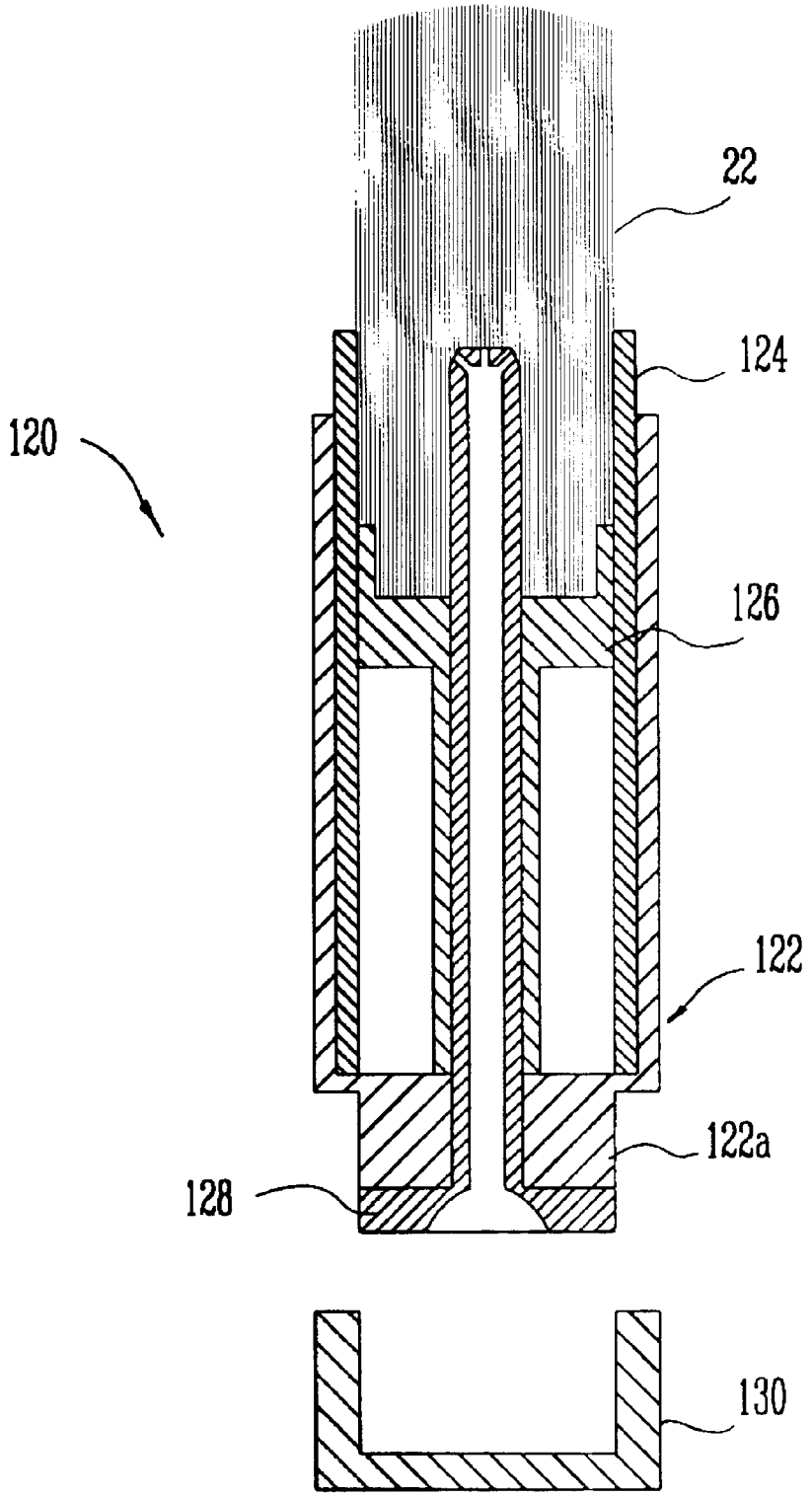
FIG. 8 is a sectional view illustrating another embodiment of the brush mounting member used for the cosmetic brush assembly according to the present invention; [and]
Figure 9:
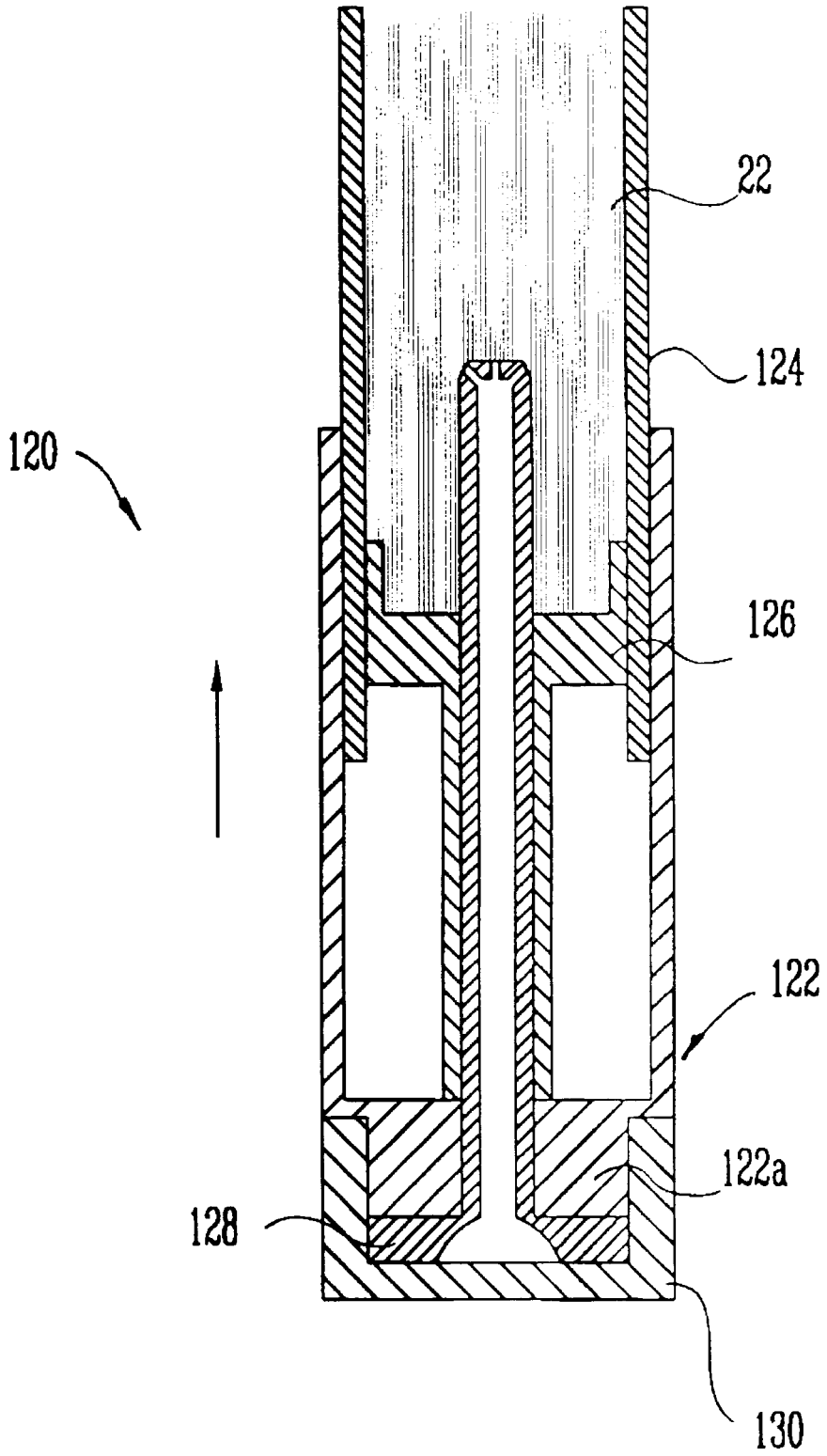
FIG. 9 is a sectional view illustrating the state before or after the brush mounting member of FIG. 8 is used.

Referring to FIGS. 8 and 9, an explanation of another brush mounting member of the cosmetic brush assembly according to the present invention will be discussed. In this case, the cosmetic powder retaining tank 30 and the adjusting part 50' are discussed with reference to FIGS. 6 and 7.

Referring to FIG. 8, a brush mounting member 120 is illustrated. The brush mounting member 120 includes a hollow housing 122 having a mounting part 122*a* which is mounted on the cosmetic powder retaining tank 30 or the top end of the adjusting part 50' (See FIGS. 6 and 7). The Brush mounting member 120 also has a first hole on the center portion of the mounting part 122*a* and a substantially cylindrical member 124 inserted into the hollow portion of the hollow housing 122 which is slidable in a length direction thereof. Brush mounting member 120 has a brush support member 126 for mounting the brush on the top end thereof. Brush support member 126 is installed on the inside of the cylindrical member 124 and forms a second hole coaxial to the first hole of the mounting housing 122 on the center portion of the mounting housing 122. Brush mounting member 120 also has an injection nozzle 128 positioned in the interior of the brush 22. The injection nozzle 128 is formed to pass through the first and second holes. On the top end of the injection nozzle 128 are a plurality of injection holes. The injection nozzle 128 also has a powder flowing end disposed towards the cosmetic powder retaining tank 30.

The brush mounting member 120, according to the present inventions further includes a cap 130 to which the mounting part 122*a* of the mounting housing 122 is assembled. The cap prevents the powder flowing end of the injection nozzle 128 from being exposed to the outside in the state where the brush mounting member 120 is separated from the cosmetic powder retaining tank 30 or the adjusting part 50.

In the state where the brush 22 is exposed to the outside of the mounting housing 122 and the cap 130 is removed out of the mounting part 122*a* of the mounting housing 122, the mounting part 122*a* is screw-coupled or fitted to the cosmetic powder retaining tank 30 or the top end of the adjusting part 50'. Next, the air pumping part 32 is manipulated and thus, the cosmetic powder in the cosmetic powder retaining tank 30 is uniformly injected to the brush 22 via the injection holes of the injection nozzle 128 along the air flow passage.

After the cosmetic powder has been applied with the cosmetic brush assembly according to the present invention, as shown in FIG. 9, the brush mounting member 120 is separated from the cosmetic powder retaining tank 30 or the adjusting part 50' and then, the cap 130 is placed on the mounting part 122*a* of the mounting housing 122. The cylindrical member 124 is raised in the arrow direction and inserts the brush 22 in the interior thereof. Next, a cover (which is not shown in the drawing) is covered on the cylindrical member 124, thereby preventing the brush 22 from being exposed to the outside.

Figure 10:
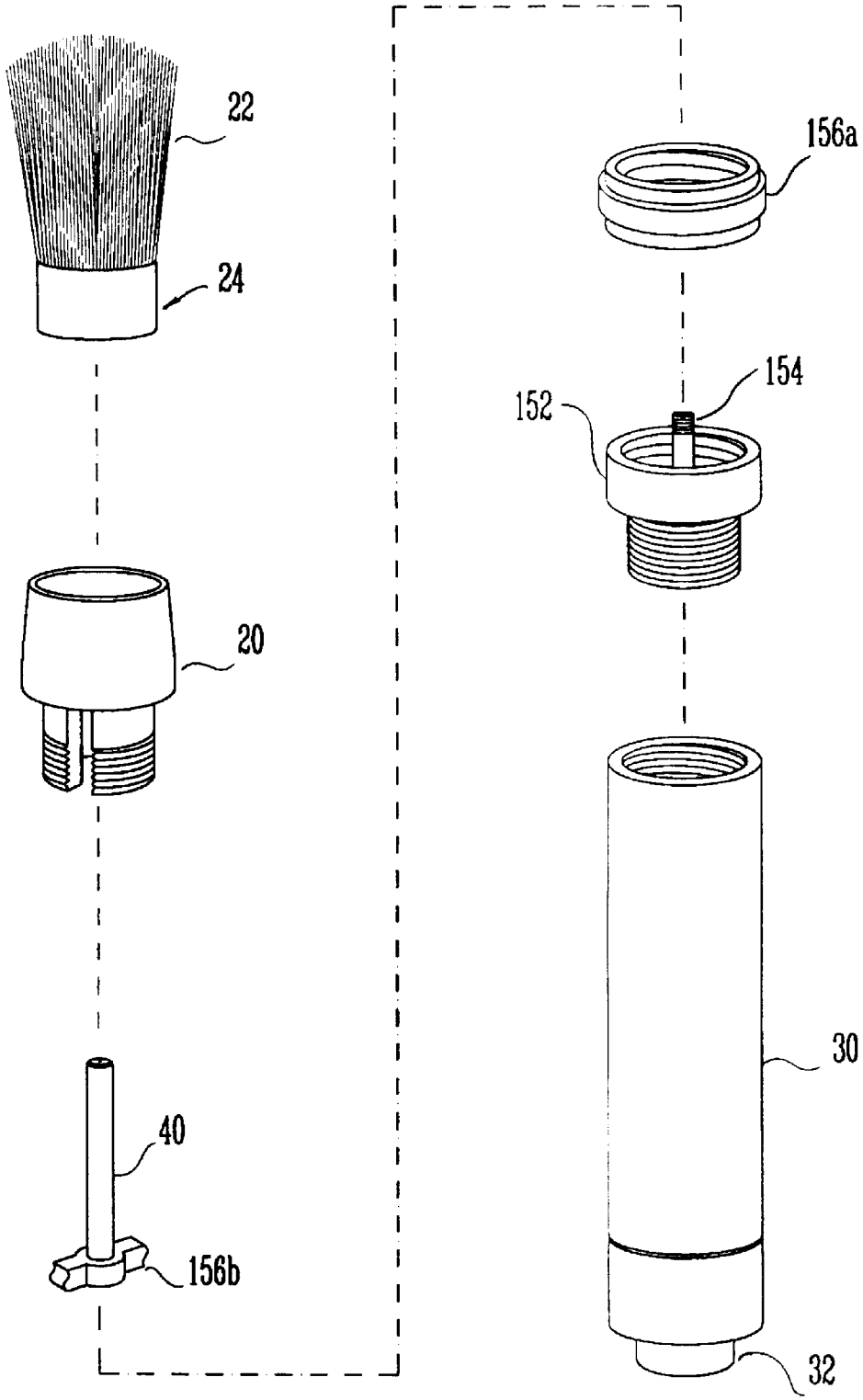
FIG. 10 is an exploded perspective view illustrating a cosmetic brush assembly according to yet another embodiment of the present invention.
Figure 13:
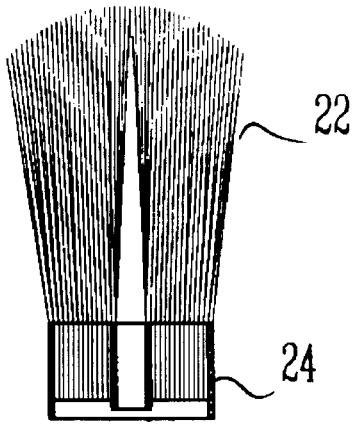
FIG. 13*a* and 13*b* are sectional and bottom views illustrating the brush fixing member separated from the brush mounting member of the cosmetic brush assembly in FIG. 10.
Figure 13:
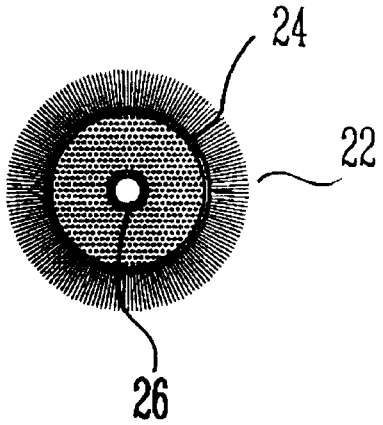

Referring to FIG. 10, the cosmetic brush assembly, according to yet another embodiment of the present invention, is embodied in the same manner as in FIG. 1, except that a first screw is formed on the outside surface of the top end of a tubular body 154. Tubular body 154 passes through the hollow portion of a hollow housing 152 and is thus slidably mounted therein. A second screw coupled to the first screw is formed on the center of a horizontal member 156*b*. FIG. 10 also illustrates a brush fixing member 24 for fixing the end of a brush 22. The brush fixing member 24 is separable from a brush mounting member 20. FIG. 13 illustrates a cylindrical tube 26 installed on the center of the lower end of the brush 22, for smoothly moving the injection nozzle 40.

Figure 11:
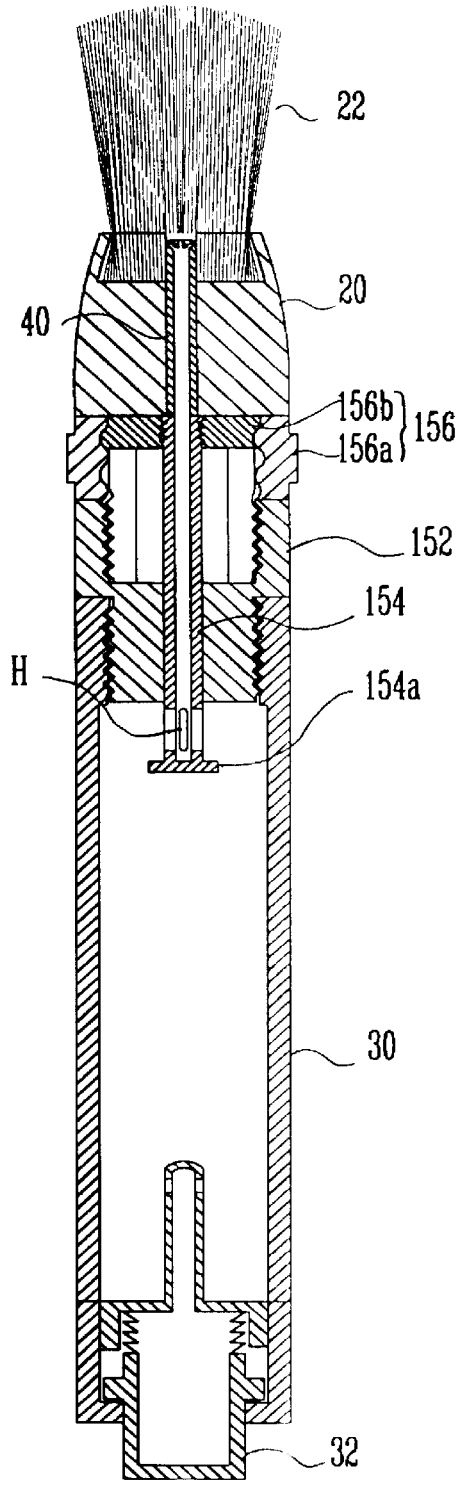
FIG. 11 is a sectional view illustrating the state where the cosmetic brush assembly is assembled and the opened end of the cosmetic powder retaining tank is in an opened state in FIG. 10.
Figure 12:
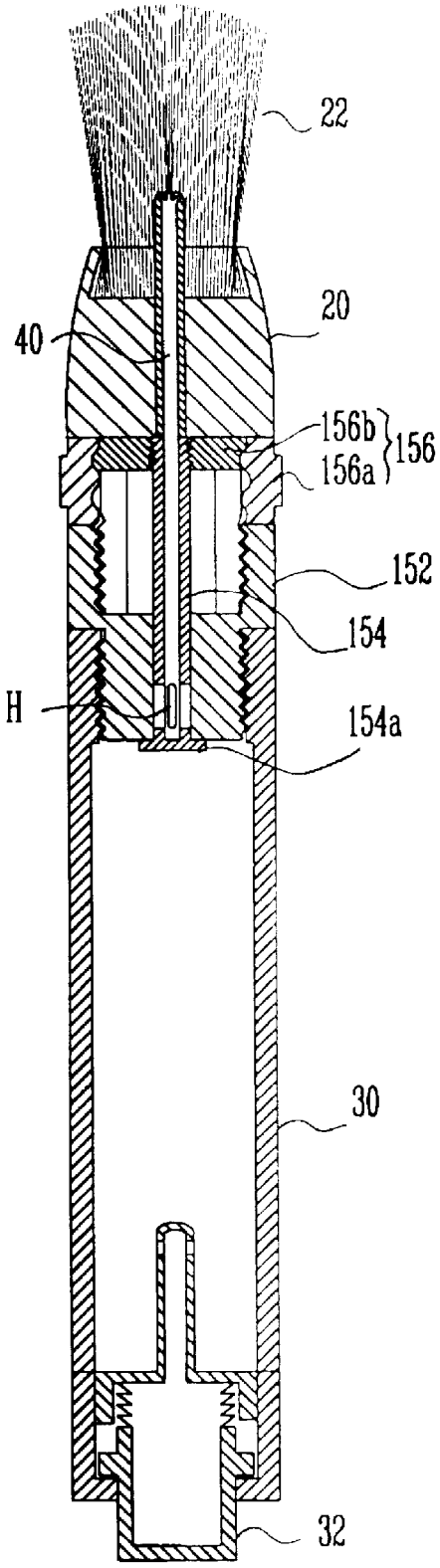
FIG. 12 is a sectional view illustrating the state where the opened end of the cosmetic powder retaining tank is in a closed state.

According to the cosmetic brush assembly of the yet another embodiment of the present invention, as shown in FIGS. 11 and 12, if a cylindrical member 156*a* rotates in a predetermined direction in the state where the first screw on the top end of the tubular body 154 is coupled to the second screw on the center of the horizontal member 156*b* (as illustrated in FIG. 10), the horizontal member 156*b* moves downwardly, with a consequence that the tubular body 154 of the injection nozzle 40 moves downwardly. As a result, the oval holes H formed on the side of the tubular body 154 are opened to the interior of the cosmetic powder retaining tank. In this state, if the air pumping part 32 operates, the cosmetic powder retained in the cosmetic powder retaining tank 30 is injected to the brush 22 along the flowing passage as mentioned above.

On the other hand, if the cylindrical member 156*a* rotates in an opposite direction, the tubular body 154 moves upwardly and, as a result, the oval holes H are closed by the hollow housing 152.

As described above, the first screw on the top end of the tubular body 154 is coupled to the second screw on the center of the horizontal member 156*b*, such that the tubular body 154, moves upwardly and downwardly in engagement with the rotation of the cylindrical member 156*a*. Hence, the cosmetic brush assembly of the yet another embodiment of the present invention does not require any elastic body for supporting the tubular body 154.

As apparently shown in the foregoing, a cosmetic brush assembly according to the present invention is capable of covering a brush with a cosmetic brush by the air pumping operation of an air pumping part, thereby ensuring a high grade of cosmetic brush assembly and preventing the cosmetic powder from leaking to the outside.

Additionally, a cosmetic brush assembly according to the present invention is capable of increasing an injection force of the cosmetic powder injected from a cosmetic powder retaining tank, thereby achieving a uniform dispersion of the cosmetic brush to the brush and adjusting an amount of cosmetic powder injected, thereby achieving a satisfactory application of cosmetic powder.

While the present invention has been described with reference to preferred embodiments, the description is illustrate of the invention and is not to be construed as limiting the invention. Various modifications may occur to those skilled in the art without departing from the true spirit and scope of the invention as defined by the appended claims.

What is claimed is:

1. A cosmetic brush assembly used for applying a cosmetic powder, said assembly comprising:

a brush mounting member having two ends;

said brush mounting member having a brush mounted on one end and having a cosmetic powder retaining tank to hold cosmetic powder disposed on the other end;

an air pump part mounted on a lower end of said cosmetic powder retaining tank;

an injection nozzle having two ends wherein one end inserts into the interior of said brush and has a plurality of injecting holes and wherein the other end is a powder flowing end disposed toward said cosmetic powder retaining tank wherein said injection nozzle guides the cosmetic powder in said cosmetic powder retaining tank to said brush by a pumping operation of said air pump part; and an adjusting part disposed between said brush mounting member and said cosmetic powder retaining tank, for adjusting an amount of the cosmetic powder injected from said cosmetic powder retaining tank to said brush through said injection nozzle.

2. The cosmetic brush assembly of claim 1, wherein said adjusting part comprises:

a hollow housing screw-coupled to said cosmetic powder retaining tank;

a tubular body movably inserted in a length-wise direction into a hollow portion of said hollow housing and supported by an elastic body for closing the opened end of said cosmetic powder retaining tank; and, a pressure member for applying a force to said tubular body in an opposite direction thereto for opening the opened end of said cosmetic powder retaining tank, wherein as the strength of the force applied by said pressure member is increased, an opened area of the opened end is increased.

3. The cosmetic brush assembly of claim 2, wherein said tubular body comprises a plurality of substantially oval holes along the length direction thereof on a side of one end thereof, and the opened area of the opened end of said cosmetic powder retaining tank is defined by the sizes of said plurality of oval holes.

4. The cosmetic brush assembly of claim 2, wherein said pressure member comprises: a substantially cylindrical member movable between said brush mounting member and said hollow housing; and a horizontal member screw-coupled on the inside of said cylindrical member and being in contact with the top end of said tubular body, said horizontal member moving in a length-wise direction of said cosmetic brush assembly in accordance with the movement of said cylindrical member and in engagement therewith, said tubular body moving in a length-wise direction thereof.

5. The cosmetic brush assembly of claim 4, wherein said cylindrical member is provided with measuring marks on the outside surface thereof, for measuring an amount of movement of said cylindrical member.

6. The cosmetic brush assembly of claim 4 wherein said hollow housing of said adjusting part has two ends, wherein said adjusting part is screw-coupled with said brush mounting member on one end and said cosmetic powder retaining tank on the other end.

7. The cosmetic brush assembly of claim 4 wherein said hollow housing of said adjusting part is fitted to said brush mounting member on the one end thereof.

8. The cosmetic brush assembly of claim 2, wherein said pressure member comprises: a substantially cylindrical member movable between said brush mounting member and said hollow housing; and a horizontal member screw-coupled on an inside of said cylindrical member and being in contact with the one end of said tubular body, said horizontal member moving in a length direction of said cosmetic brush assembly in accordance with the movement of said cylindrical member and in engagement therewith, said tubular body moving in a length-wise direction thereof.

9. The cosmetic brush assembly of claim 8, wherein said cylindrical member is provided with measuring marks on an outside surface thereof, for measuring an amount of movement of said cylindrical member.

10. The cosmetic brush assembly of claim 8 wherein said hollow housing of said adjusting part has two ends, wherein said adjusting part is screw-coupled with said brush mounting member on one end and said cosmetic powder retaining tank on the other end.

11. The cosmetic brush assembly of claim 8 wherein said hollow housing of said adjusting part is fitted to said brush mounting member on the one end thereof.

12. The cosmetic brush assembly of claim 1, wherein said pressure member comprises:

a substantially cylindrical member between said brush mounting member and said hollow housing; and, a horizontal member screw-coupled on an inside of said cylindrical member wherein said horizontal member is in contact with a top end of said tubular body, wherein said horizontal member moves in a length-wise direction of said cosmetic brush assembly along the length of said cylindrical member; and wherein said tubular body, in engagement with said horizontal member also moves in a length-wise direction of said cosmetic brush assembly.

13. The cosmetic brush assembly of claim 12, wherein said cylindrical member is provided with measuring marks on an outside surface thereof, for measuring an amount of movement of said cylindrical member.

14. The cosmetic brush assembly of claim 12, wherein said hollow housing of said adjusting part is screw-coupled with said brush mounting member and said cosmetic powder retaining tank on the both ends thereof.

15. The cosmetic brush assembly of claim 12, wherein said hollow housing of said adjusting part is fitted to said brush mounting member on the top end thereof.

16. A cosmetic brush assembly comprising:

an air pumping part on a bottom end thereof;

a cosmetic powder retaining tank retaining a cosmetic powder in an interior thereof;

a brush mounting member mounted on a top portion of said cosmetic powder retaining tank, said brush mounting member comprising a hollow housing having a mounting part on a bottom portion of said hollow housing which is mounted on a top portion of said cosmetic powder retaining tank;

said mounting part having a first hole on a center portion of said mounting part;

a substantially cylindrical member inserted into a hollow portion of said hollow housing and slidable in a length direction thereof;

a brush support member for mounting a brush on the top portion of said cosmetic brush assembly, installed inside said cylindrical member and forming a second hole coaxial to said first hole of said mounting housing on the center portion thereof; and, an injection nozzle positioned in the interior of said brush on the top end of said cosmetic brush assembly on which a plurality of injection holes are formed to pass through said first and second holes and having a powder flowing end disposed towards said cosmetic powder retaining tank.

17. The cosmetic brush assembly of claim 16, further comprising a cap for covering said mounting part on a lower portion of said mounting housing.

18. A cosmetic brush assembly comprising:

a brush mounting member into which a brush fixing member fixing the lower end of a brush is separably inserted and mounted;

an air pump part mounted on a lower end of a cosmetic powder retaining tank;

an injection nozzle having a plurality of injecting holes inserted into the interior of a brush for guiding cosmetic powder in said cosmetic powder retaining tank from a powder flowing end disposed toward said cosmetic powder retaining tank to said brush;

wherein said cosmetic powder flows from the powder flowing end to the brush by a pumping operation of said air pump part;

a hollow housing mounted between said brush mounting member and said cosmetic powder retaining tank;

a tubular body having a first screw on a top end of the tubular body, wherein said tubular body is installed movably in a length-wise direction in a hollow portion of said hollow housing; and a cosmetic powder injection amount adjusting part composed of a cylindrical member movable between said brush mounting member and said hollow housing and a horizontal member extending across the inside diameter of said cylindrical member in a screw-coupled state to the inside of said cylindrical member having a through hole in a center position of said horizontal member, wherein said through hole forms a second screw coupling to said first screw on the tubular body.

19. The cosmetic brush assembly of claim 18, wherein said injection nozzle is attached on said horizontal member on the lower portion of said injection nozzle, for injecting the cosmetic powder in said cosmetic powder retaining tank to said brush via said tubular body and said injection nozzle.

* * * * *